United States Patent [19]

Harstad

[11] Patent Number: 4,515,044

[45] Date of Patent: May 7, 1985

[54] QUICK CHANGE RATCHET WRENCH

[76] Inventor: Larry V. Harstad, 19326 Pac. Hwy. S., Space 10, Des Moines, Wash. 98188

[21] Appl. No.: 200,255

[22] Filed: Oct. 23, 1980

[51] Int. Cl.[3] ..... B25B 13/46

[52] U.S. Cl. ..... 81/61

[58] Field of Search ..... 81/60–63.2

[56] References Cited

U.S. PATENT DOCUMENTS

| | | | |
|---|---|---|---|
| 5,009 | 3/1847 | Avery . | |
| 61,340 | 1/1867 | Jackson | 81/61 |
| 556,151 | 3/1896 | Johnson . | |
| 807,534 | 12/1905 | Barnes . | |
| 898,806 | 9/1908 | Walker . | |
| 1,171,063 | 2/1916 | Nigborowicz | 81/61 |
| 1,270,263 | 6/1918 | Burnson | 81/61 |
| 1,578,065 | 3/1926 | Bemus et al. | 81/61 |
| 2,300,479 | 11/1942 | Wilson | 81/60 |
| 3,258,998 | 7/1966 | Harper | 81/2 |
| 3,349,653 | 10/1967 | Kaufman et al. | 81/60 |
| 3,838,614 | 10/1974 | O'Donnell | 81/60 |

*Primary Examiner*—James L. Jones, Jr.
*Attorney, Agent, or Firm*—Morris A. Case

[57] ABSTRACT

A cylinder is rotatably located in a head of a wrench. Ratchet teeth located in a groove around the periphery of the cylinder acts in conjunction with a pawl to secure the cylinder in position and to provide ratchet action. An insert with axially located socket rotates with the cylinder to act on a fastener.

4 Claims, 6 Drawing Figures

10
12
14
16
18
20
22
24
26
28
30
32
34
36
38
40
42
44
46
47
48
50
52
54
56
58
60
62
64
66
68
70
72
74
76
78
80
82
74a
76a
78a
80a
74b
76b
78b

QUICK CHANGE RATCHET WRENCH

BACKGROUND OF THE INVENTION

There are numerous types of ratchet wrenches that are used to quickly secure or loosen a fastener. The wrenches use a radially extending square projection that in turn is used to quickly change to different size sockets to be used on different sized fasteners. This works very well, however, it does have a disadvantage in the situation where space is limited; so that the wrench plus the axially extending socket does not permit use. A ratchet wrench was discovered that can be used in the conventional manner in conjunction with various size sockets, and in addition various size sockets may be quickly changed within the wrench head itself to provide use in limited access areas.

SUMMARY OF THE INVENTION

A ratchet wrench has a handle with a head to contain a rotatable hollow cylinder having ratchet teeth in a recess around its periphery. A series of inserts each rotatable with and contained within the hollow part of the cylinder have different size axially located means for meshing with fasteners. An arm rotatably mounted in the handle has a pawl, on one end, for resiliently engaging the ratchet teeth and for containing the cylinder, and a lever extending outside the handle on the other end to disengage and permit removal of the cylinder with insert.

It is an object of this invention to provide a quick change ratchet wrench.

It is another object of this invention to provide a quick change ratchet wrench for fasteners having limited clearance to the fastener.

DETAILED DESCRIPTION

Figures 1, 2, 3, 4:
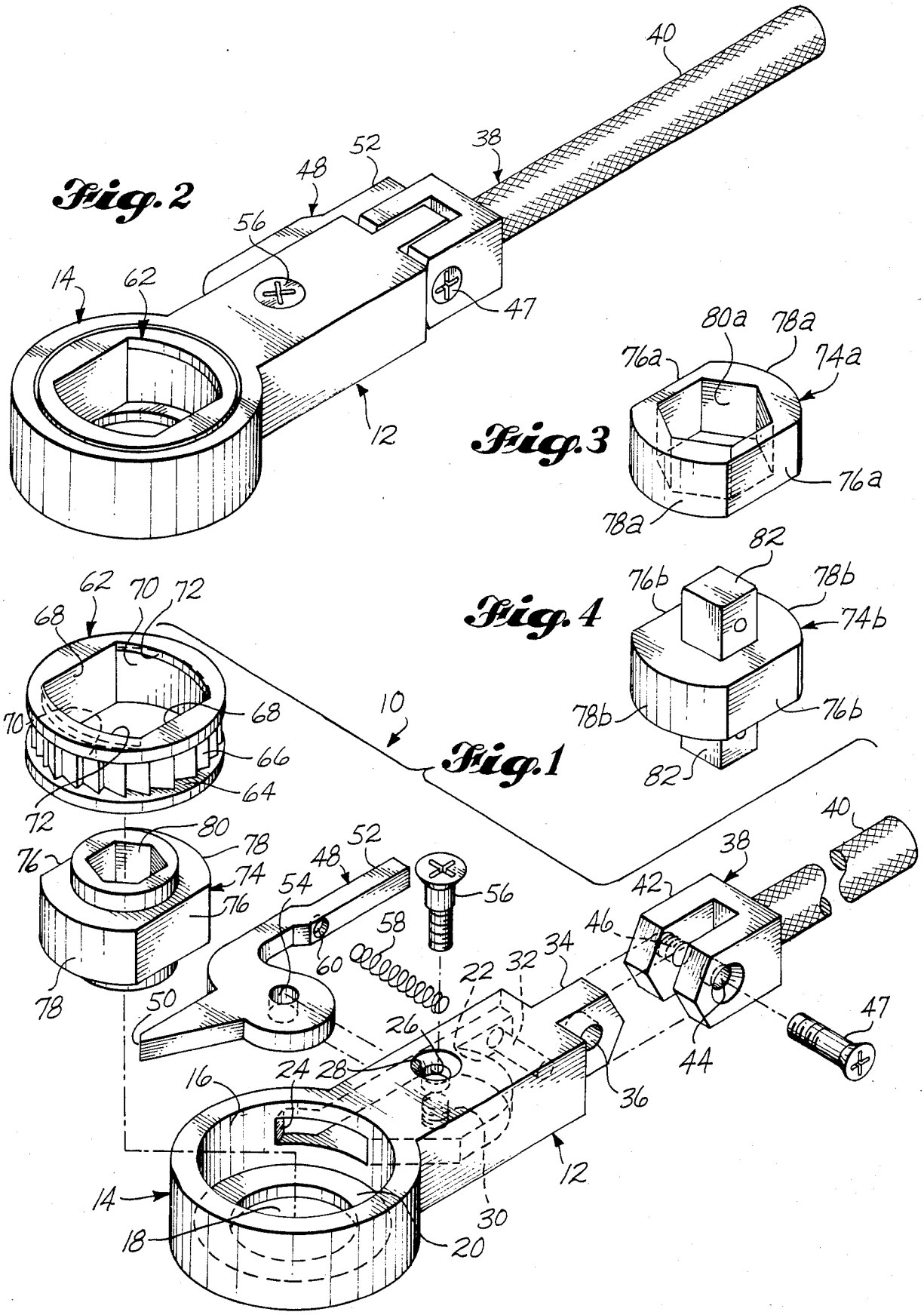
FIG. 1 shows an exploded perspective view of the quick change ratchet wrench of this invention.
FIG. 2 shows an assembled perspective view of the wrench of FIG. 1 without an insert.
FIG. 3 shows a perspective view of a socket type insert for this invention.
FIG. 4 shows a perspective view of an insert for use with a socket set.
Figure 5:
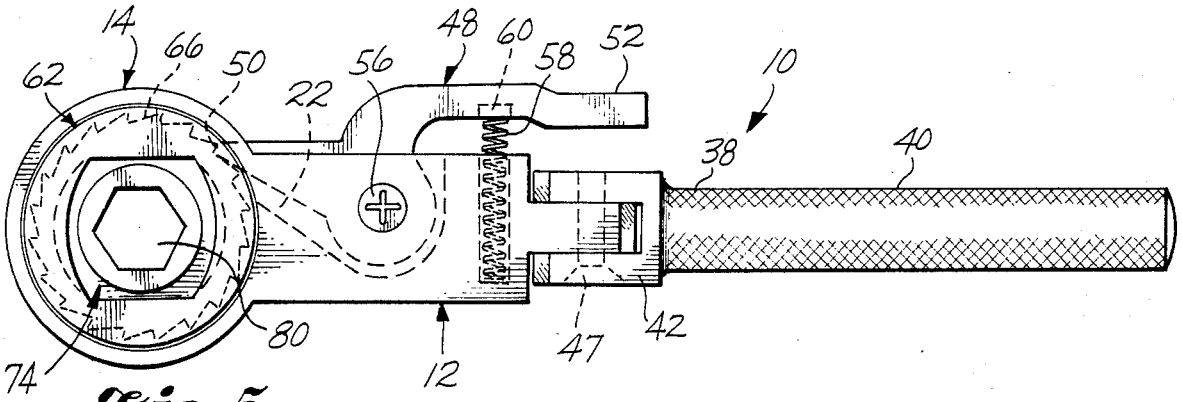
FIG. 5 is a plan view of the wrench of FIG. 1.
Figure 6:
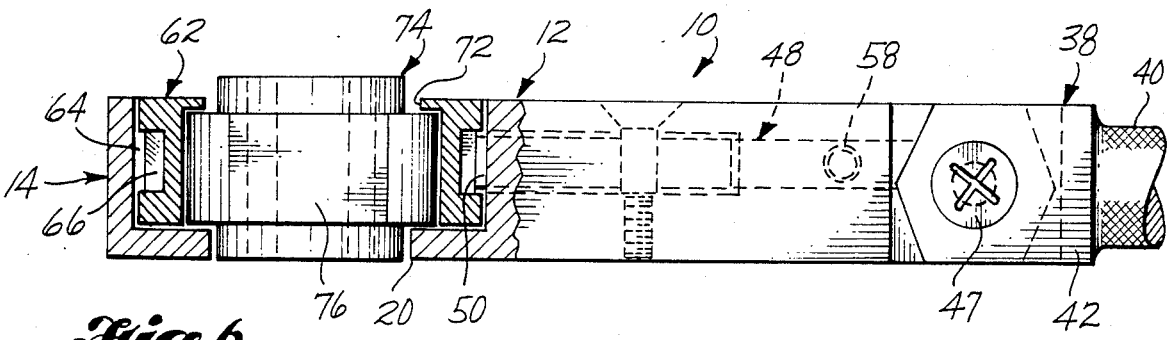
FIG. 6 is a side view of the wrench of FIG. 5.

Quick change ratchet wrench 10 has a body or handle 12 with a head 14 on one end. The head has a cylindrical shaped opening 16 extending in from one side, and a smaller diameter circular opening 18 extending inward from the other side forming a lip 20. The handle has a slot 22 that communicates at 24 with the side of the cylindrical shaped opening in the head. A hole 26 extends normal to the direction of the slot and that hole has a countersink 28 on one end and is threaded at 30 on the other end, and a second hole in the handle extends inward at 32. At the end of the handle opposite the head is a projection 34 with hole 36. A handle extension 38 has a shank 40 and a clevis portion 42. A hole 44, threaded at 46, extends through the legs of the clevis. The clevis on the handle extension fits over the projection 34 of the handle and the two are pivotally joined with bolt 47.

An arm 48, is pivotally mounted in the slot 22 in the handle 12. The arm has a wedge shape 50 on one end that extends into the cylindrical shaped opening 16 of the head 14 with the wedge acting as a pawl, and an extension 52, on the other end of the arm extends outside the handle, and acts as a lever for rotating the pawl outside the cylindrical shaped opening. The arm has a hole 54, and a bolt 56 extends through that hole and screws into threads 30 in the arm to pivotally join the arm to the handle. A spring 58, fits into hole 32 of the handle and hole 60 of the arm to continually and resiliently urge the pawl into the cylindrical shaped opening.

A cylinder 62, is sized to rotatably fit in the cylindrical shaped opening 16 in the head 14. This cylinder has a centered narrow groove 64 around the periphery, and ratchet teeth 66 are located in that groove. The cylinder is hollow, and in one preferred embodiment the opening in the cylinder has two opposite parallel sides 68, and two opposite elliptical sides 70. At one side of the cylinder the elliptical sides are shortened for a distance in to provide a pair of lips 72.

An insert 74, has sides 76 and 78 sized to closely fit inside sides 68 and 70 of the cylinder 62, and to cause the insert to rotate with that cylinder. An axially located socket shaped opening 80, extends through the insert. This opening is sized to fit the head of a particular sized nut, or bolt or other type of fastener. FIG. 3 shows a fastener **74*a*, having sides 76*a* and 78*a* that are sized to fit into the cylindrical member 62. This insert has a different size socket shaped opening 80*a***. A series of various sized inserts are used to provide a complete set of sockets for use on fasteners.

FIG. 4 shows yet another variation of an insert **74*b*, with sides 76*b* and 78*b* sized to fit into cylindrical member 62. This insert is provided with a pair of projections 82**. These projections are square in shape, and are sized to fit into the drive part of a set of sockets, not shown, to permit the use of a convential socket set in connection with this invention.

In use the insert with the correct size socket is selected. The insert is placed inside the cylinder from the side opposite the lip 72, the lever on the arm is depressed to clear the pawl from the cylindrical opening, and to allow placement of the cylinder with insert inside the head. The lever is released, the pawl resiliently presses against the ratchet teeth, and the pawl acts against the sides of the groove to retain the cylinder inside the head. The lip 20 on the head and the lip on the cylinder keep the insert inside the cylinder. The socket is placed on the head of a fastener, and the fastener is tightened by ratchet action with the wrench. The insert with socket opening permits tightening in close areas. To change inserts the lever arm is depressed to move the pawl aside, the cylinder with insert removed, the cylinder with a different size insert placed in the head and the lever arm released to lock the cylinder with new insert into the head.

I claim:

1. A quick change ratchet wrench comprising: a handle having an integral head on one end with said head having a cylindrical shaped opening extending in from one side of the head, and a concentric smaller diameter circular opening extending in from the other side of the head to form a lip, a hollow cylinder sized to rotatably fit in the cylindrical shaped opening with said cylinder having a narrow recess with ratchet teeth around the periphery and having a lip adjacent opposite sides of the hollow interior, an insert sized to fit inside and to move with the hollow cylinder and contained by the lip in the cylinder and the lip in the opening in the head with said insert having means for joining to a fastener, a ratchet teeth contacting pawl pivotally mounted in the handle with said pawl having a resiliently held lever arm extending outside the handle to permit the pawl to be moved out of contact with the ratchet teeth to permit entry and removal of the cylinder from the head.

2. A quick change ratchet wrench as in claim 1 further comprising a pivotally mounted extension secured to an end of the handle opposite the head.

3. A quick change ratchet wrench as in claim 1 wherein the means for joining the insert to a fastener comprises the insert having an axially located opening making up a socket.

4. A quick change ratchet wrench as in claim 1 wherein the means for joining the insert to a fastener comprises the insert having an axially located extension sized to match the drive part of a socket set.

* * * * *